US008659383B2

(12) United States Patent
Cheng

(10) Patent No.: US 8,659,383 B2
(45) Date of Patent: Feb. 25, 2014

(54) MAGNETIC MEMBER

(75) Inventor: Ching-Yuan Cheng, Taoyuan County (TW)

(73) Assignee: Mag. Layer Scientific Technics Co., Ltd., Hukou Township, Hsinchu County (TW)

( * ) Notice: Subject to any disclaimer, the term of this patent is extended or adjusted under 35 U.S.C. 154(b) by 7 days.

(21) Appl. No.: 13/111,397

(22) Filed: May 19, 2011

(65) Prior Publication Data

US 2012/0293291 A1 Nov. 22, 2012

(51) Int. Cl.
*H01F 5/00* (2006.01)
*H01F 27/28* (2006.01)

(52) U.S. Cl.
USPC ..... 336/200; 336/229; 336/232

(58) Field of Classification Search
USPC ..... 336/200, 229, 232
See application file for complete search history.

(56) References Cited

U.S. PATENT DOCUMENTS 3,287,795 A * 11/1966 Chambers et al. ..... 29/856
5,212,345 A * 5/1993 Gutierrez ..... 174/556

* cited by examiner

*Primary Examiner* — Tsz Chan
(74) *Attorney, Agent, or Firm* — Muncy, Geissler, Olds & Lowe, P.C.

(57) ABSTRACT

A magnetic member includes a substrate and a magnetic element. A configuration groove is formed on the substrate, so as to accommodate the magnetic element. Furthermore, a first electrode is formed on a periphery of the substrate, so that ends of a conductive coil of the magnetic element are electrically laid thereon. A guide groove is formed on a position adjacent to the first electrode, and the guide groove is filled with a conductive metal, so that the first electrode is electrically connected to the guide groove. In this way, after an IR reflow process of the magnetic member, conditions of abnormal adhesion and poor conductivity are avoided. The magnetic member is applicable to various electronic devices requiring the magnetic elements, for example, a communication circuit and a frequency conversion circuit.

10 Claims, 10 Drawing Sheets

MAGNETIC MEMBER

BACKGROUND OF THE INVENTION

1. Field of Invention

The present invention relates to a magnetic member, and more particularly to a magnetic member, in which a penetrated-form guide groove is formed on an edge of a substrate, and the guide groove is electrically connected to a first electrode, so as to avoid an adhesion condition and a poor conduction condition generated after an IR reflow process.

2. Related Art

Currently, any electronic device mainly includes a plurality of active elements and passive elements, and the passive elements match active elements to form an electronic control loop having a specific effect. The passive elements are, for example, a magnetic element and a resistor, in which the magnetic element (for example, a transformer or an inductor) has a characteristic that a magnetic field is generated once a current is conducted, and the magnetic element is also one of very important elements of the current electronic device. Take a portable cell phone as an example, many functions are required to match the passive magnetic elements to achieve the specific effect. However, the current electronic device pursues miniaturization, and the performance is required to be appropriately improved, so that the miniaturization of the magnetic element is imperative. Furthermore, in order to enable the magnetic element to be easily laid on a circuit board in a manufacturing process, the magnetic element may also be encapsulated into an aspect similar to an integrated circuit chip, so as to be laid quickly. FIG. 1 is a three-dimensional outside view of a conventional magnetic member. Referring to FIG. 1, the magnetic member 10 includes a substrate 101 and a magnetic element 102. A configuration groove 1011 is formed on the substrate 101, so as to accommodate the magnetic element 102. Furthermore, a first electrode 1012 is disposed on a plane of the substrate 101, a second electrode 1013 is formed on another plane opposite to the first electrode 1012, a through hole 1014 is formed between two conductive terminals (1012 and 1013), and the through hole 1014 is filled with a conductive material 1015, so that the first electrode 1012 is electrically connected to the second electrode 1013. Accordingly, the magnetic member 10 may be appropriately miniaturized. However, during an IR reflow process of the magnetic member 10, the magnetic member 10 cannot be surely attached to the corresponding electrode. FIG. 2 is a schematic implementation view of the conventional magnetic member. Referring to FIG. 2, during the IR reflow process of the magnetic member 10, tin liquid 11 usually cannot smoothly enter a position between a bottom edge of the second electrode 1013 and a circuit board 12, so that the magnetic member 10 cannot be steadily adhered to the circuit board 12 through solidification of the tin liquid 11. Further, the tin liquid 11 only contacts a part of the second electrode 1013, so that the circuit board 12 only can be electrically connected to the second electrode 1013 through the contacted part. Therefore, a condition of poor conductivity is easily generated.

SUMMARY OF THE INVENTION

Accordingly, the present invention is directed to a magnetic member, capable of avoiding an adhesion condition and a poor conduction condition after an IR reflow process. In order to achieve the above objective, the present invention provides a magnetic member, which mainly includes a substrate and a magnetic element. A configuration groove is formed on the substrate, so as to accommodate the magnetic element. A first electrode is formed on a plane of the substrate, so that ends of a conductive coil wound on the magnetic element are laid thereon. Furthermore, a penetrated-form guide groove is formed on an edge of the substrate adjacent to the first electrode, and the guide groove is filled with a conductive material, so that the first electrode is electrically connected to the guide groove. In this way, after an IR reflow process of the magnetic member according to the present invention, tin liquid has a large contact area with the guide groove, and the magnetic element may be steadily adhered above a circuit board, and due to the increase of the conduction area, a poor conduction condition is further avoided.

DETAILED DESCRIPTION OF THE INVENTION

Figure 1:
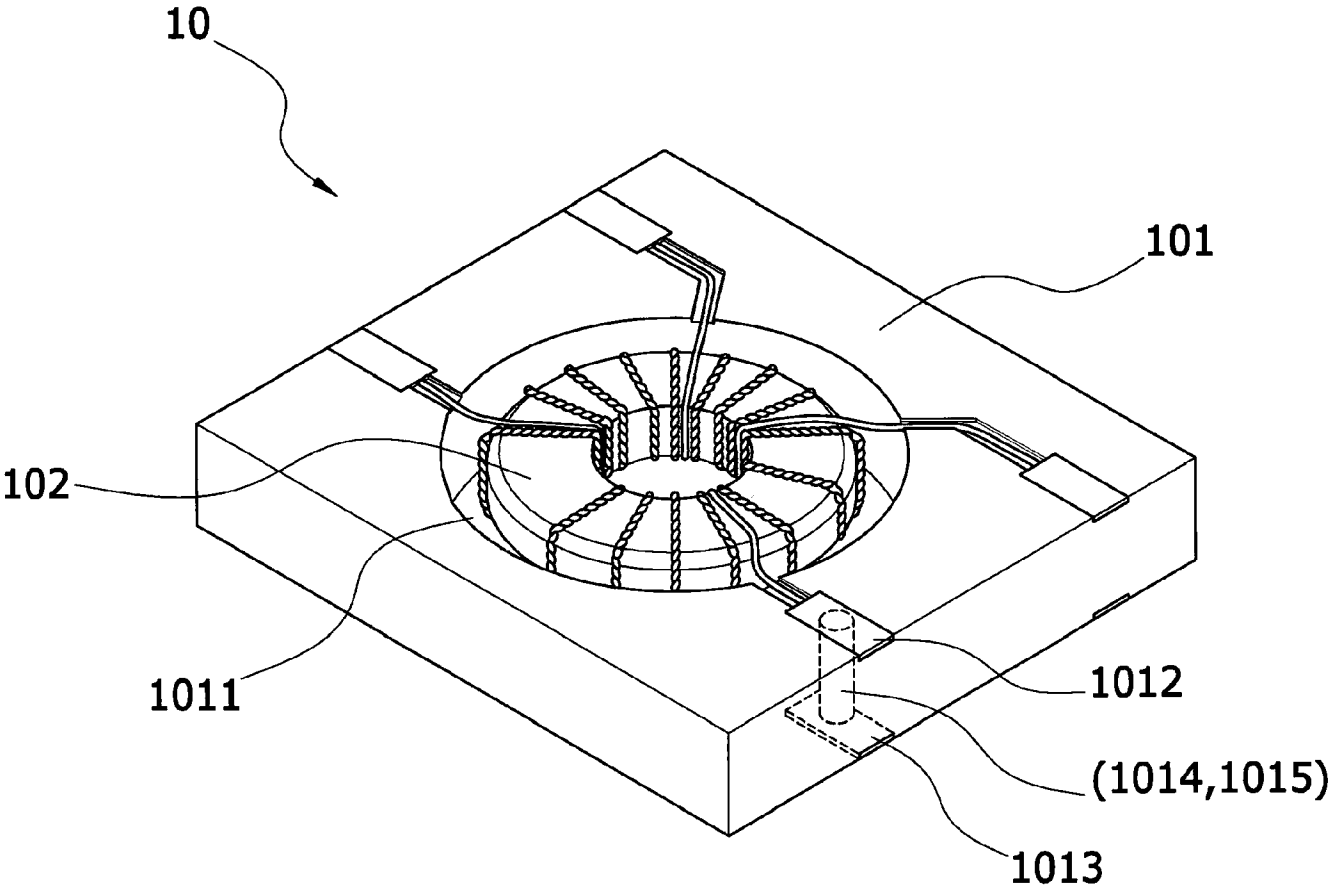
FIG. 1 Prior Art
FIG. 1 is a three-dimensional outside view of a magnetic member.
Figure 2:
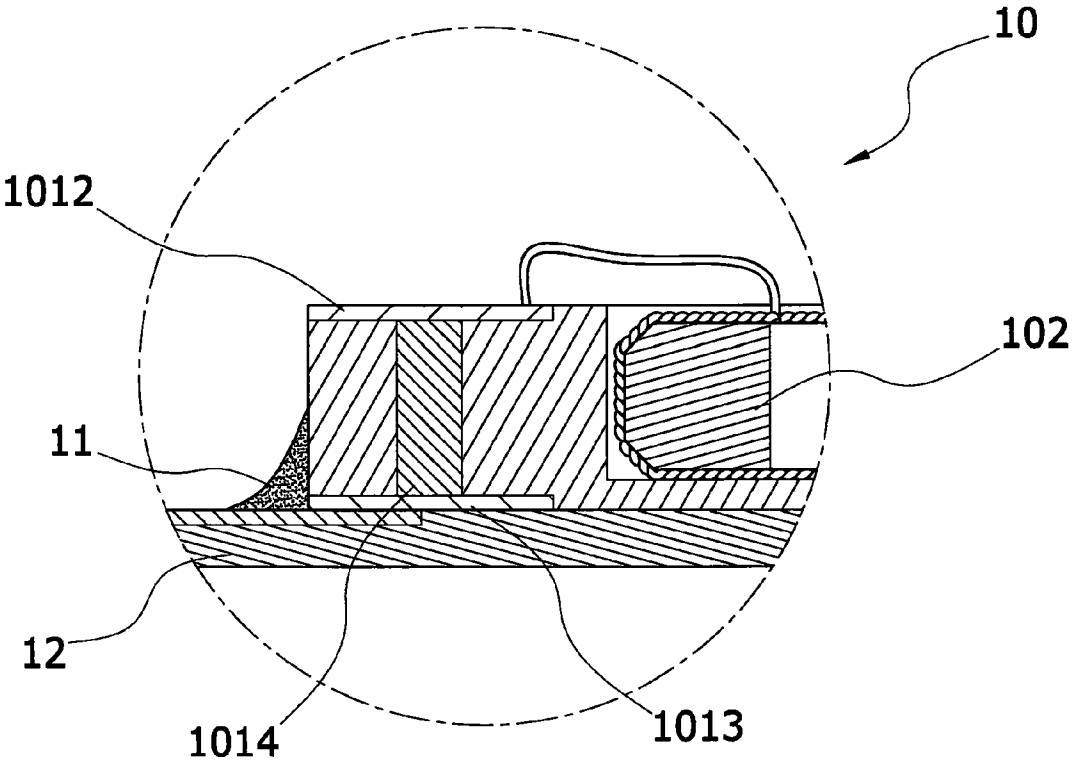
FIG. 2 Prior Art
FIG. 2 is a schematic implementation view of a conventional magnetic member.
Figure 3:
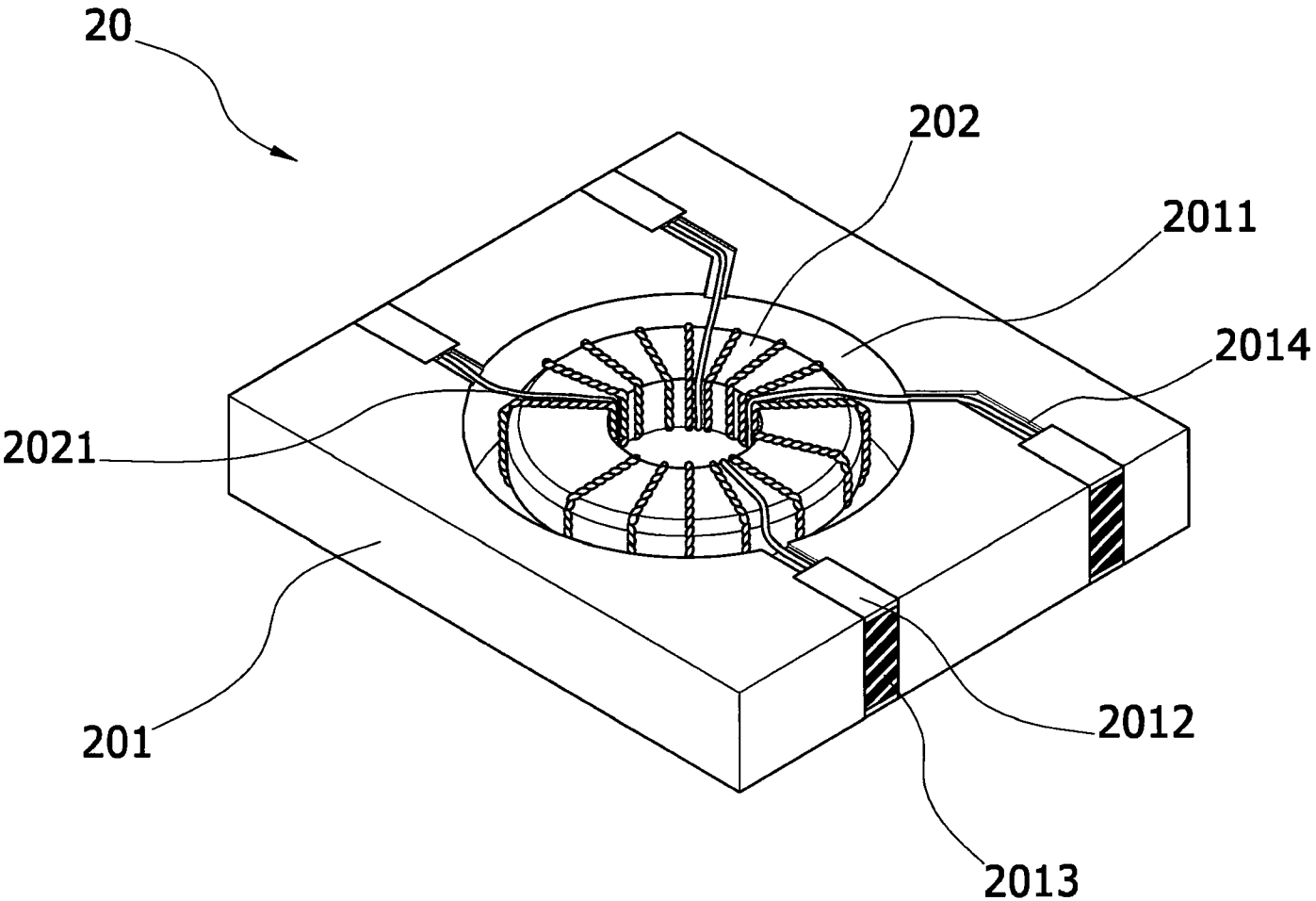
FIG. 3 is a three-dimensional outside view of the present invention.

FIG. 3 is a three-dimensional outside view of the present invention. Referring to FIG. 3, a magnetic member 20 according to the present invention mainly includes a substrate 201 and a magnetic element 202. The substrate 201 is in a state of an electrical substrate, and a configuration groove 2011 is formed thereon for accommodating the magnetic element 202. Furthermore, a first electrode 2012 is formed on an external surface of the substrate 201, a penetrated-form guide groove 2013 is formed on a position adjacent to the first electrode 2012, and the guide groove 2013 is filled with a conductive material, so that the first electrode 2012 is electrically connected to the guide groove 2013 under a normal state. Furthermore, a wiring groove 2014 is formed on a periphery of the first electrode 2012, and the other end edge of the wiring groove 2014 is in communicate with the configuration groove 2011, so as to configure a conductive coil 2021 on the magnetic element 202. Furthermore, the magnetic element 202 may be pre-wound with the conductive coil 2021 which may be a single conductive coil or multiple groups of conductive coils. The first electrode 2012 is also increased or decreased with the number of the conductive coils 2021, and one conductive coil 2021 matches one first electrode 2012 for implementation, but the present invention is not limited thereto. Furthermore, the single magnetic element 202 is taken as an example in the present invention, but the present invention is not limited thereto. A plurality of configuration grooves 2011 may be formed, so as to respectively accommodate a plurality of magnetic elements 202, and the first electrode 2012 is also increased or decreased with the number of the magnetic elements 202. Furthermore, an electrical line is formed on a surface edge of the substrate 201, so as to generate electrical connection having a specific effect.

Figure 4:
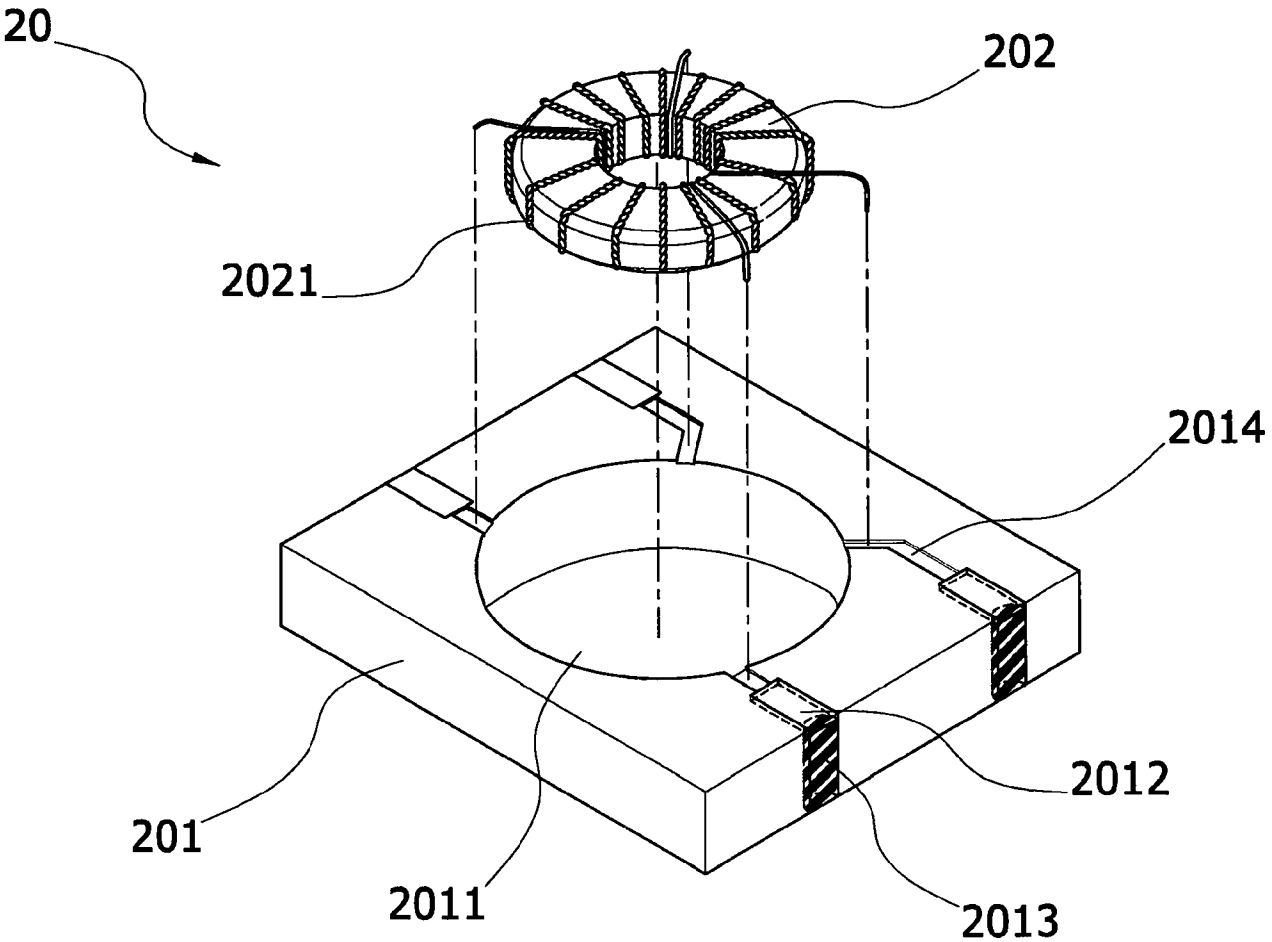
FIG. 4 is a first schematic combined view of members according to the present invention.
Figure 5:
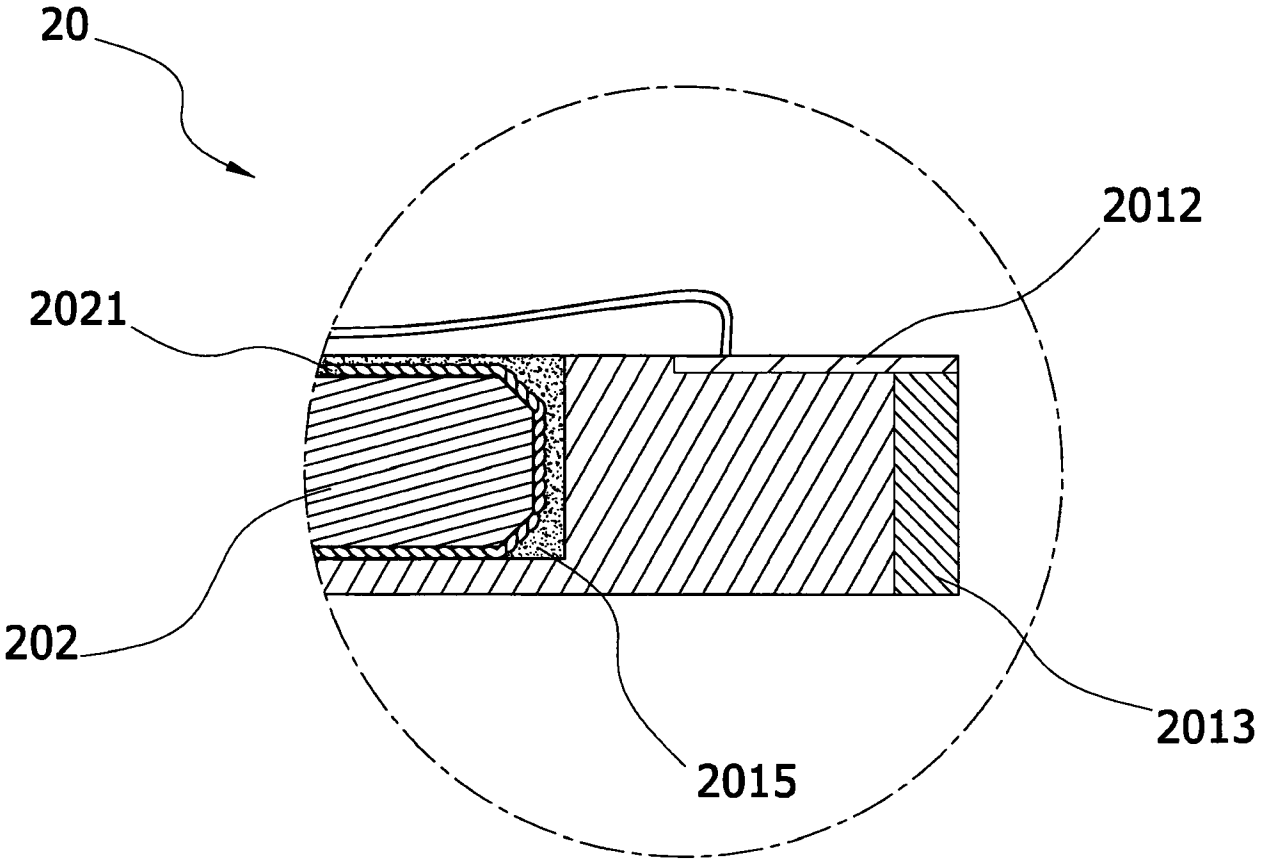
FIG. 5 is a second schematic combined view of members according to the present invention.

FIG. 4 is a first schematic combined view of members according to the present invention. Based on the above descriptions, referring to FIG. 4, when the magnetic member 20 is configured, the magnetic element 202 is placed in the configuration groove 2011, then the ends of the conductive coil 2021 wound on the magnetic element 202 are respectively placed in the corresponding wiring groove 2014, so that two ends of the conductive coil 2021 are respectively electrically connected to a first electrode 2012. Furthermore, when the magnetic element 202 completes the configuration, the configuration groove 2011 is filled with an adhesive layer 2015, so that the magnetic element 202 is protected by the adhesive layer 2015, in which the adhesive layer is a compound of an epoxy resin type. FIG. 5 is a second schematic combined view of members according to the present invention, and the magnetic element 202 completed through the above process is as shown in FIG. 5. Based on the above descriptions, after the members of the magnetic element 202 complete the configuration, the formed electrical layout is as described below.

The guide groove 2013→the first electrode 2012→the magnetic element 202→the first electrode 2012→ . . . which shows a series circuit, and an external circuit may be electrically connected to the magnetic element 202 configured inside the magnetic member 20 through the guide groove 2013.

Figure 6:
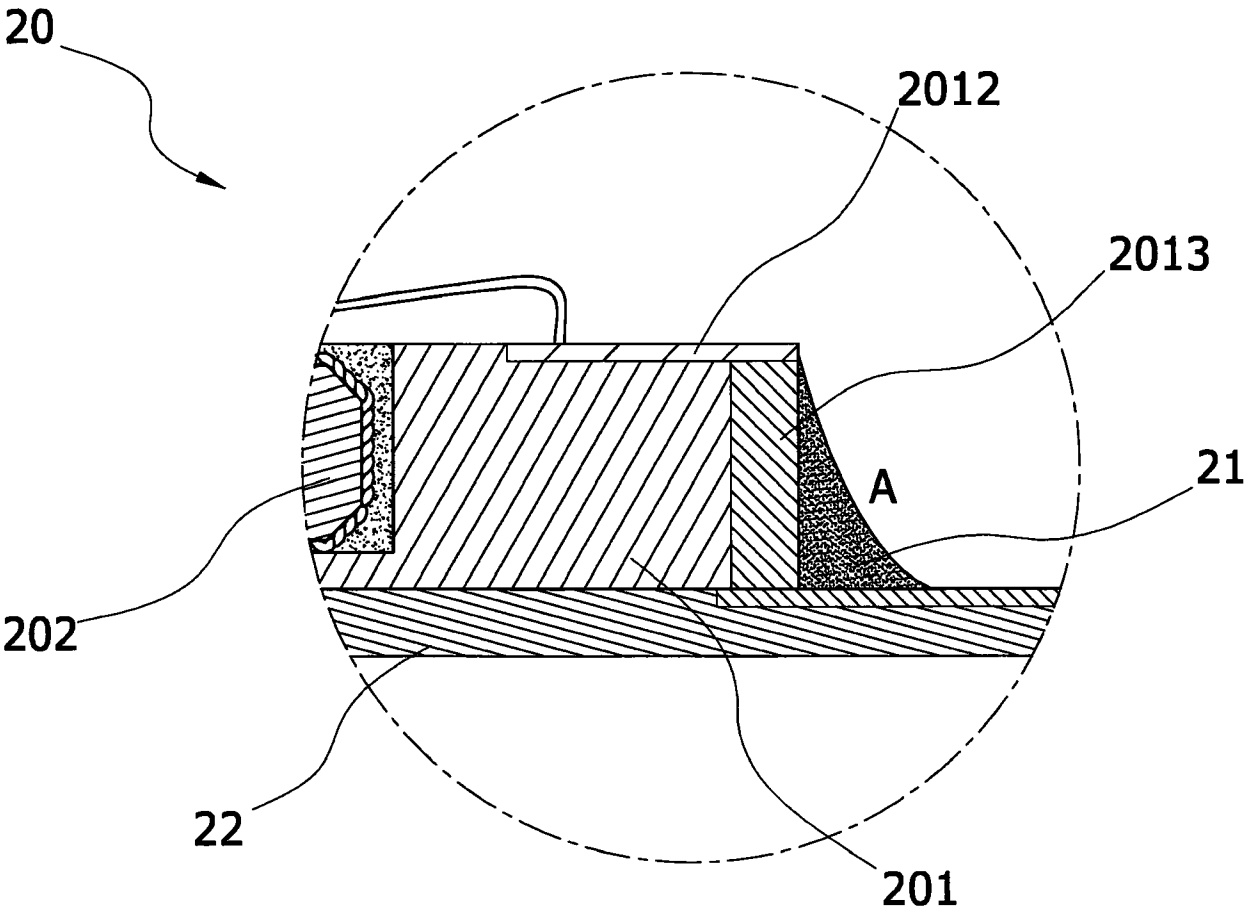
FIG. 6 is a schematic implementation view of the present invention.
Figure 7:
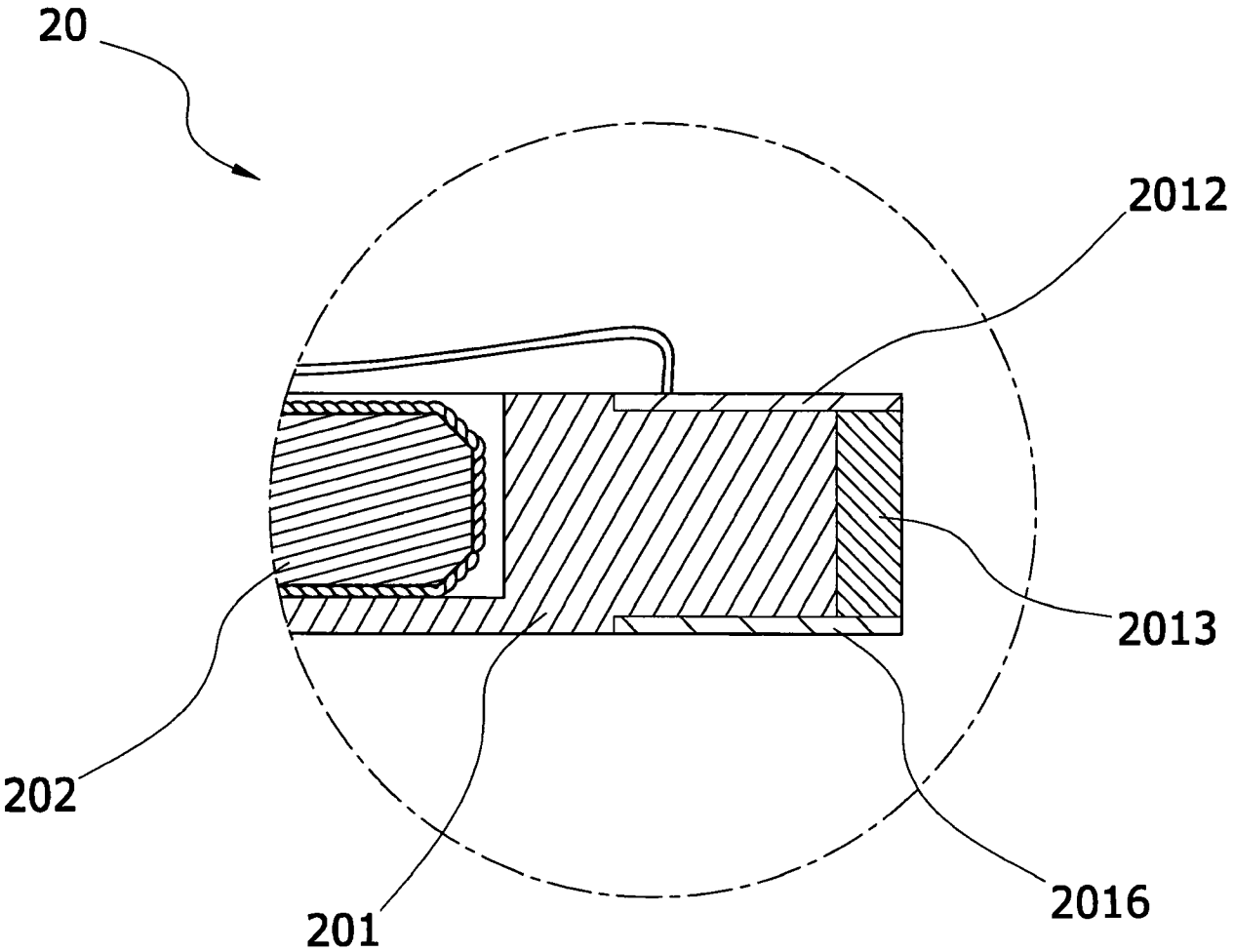
FIG. 7 is a first embodiment of the present invention.

FIG. 6 is a schematic implementation view of the present invention. Referring to FIG. 6, during an IR reflow process of the magnetic member 20, tin liquid 21 may be attached to a surface edge of the guide groove 2013 to form a preferred "tin climbing phenomenon" (as shown by A in the figure), so that the magnetic member 20 may be steadily adhered to a circuit board 22, and as the tin liquid 21 has a large contact area with the guide groove 2013, the circuit board 22 generates good conductivity with the magnetic member 20. FIG. 7 is a first embodiment of the present invention. Referring to FIG. 7, a first electrode 2012 may be formed on the substrate 201, and a second electrode 2016 may be further formed on another plane opposite to the first electrode 2012. The guide groove 2013 is formed between two conductive terminals (2012 and 2016), so that the two conductive terminals (2012 and 2016) are electrically connected. Accordingly, after the magnetic member 20 completes the configuration, the formed electrical layout is as described below: the second electrode 2016→the guide groove 2013→the first electrode 2012→the magnetic element 202→the first electrode 2012, so that according to the IR reflow process of this embodiment, the tin liquid may not only contact the guide groove 2013 but also contact the second electrode 2016, so the magnetic member 20 may be steadily adhered to the circuit board 22, and a conduction area is relatively expanded due to expansion of the contact area, thereby generating good conductivity between the magnetic member 20 and the circuit board 22.

Figure 8:
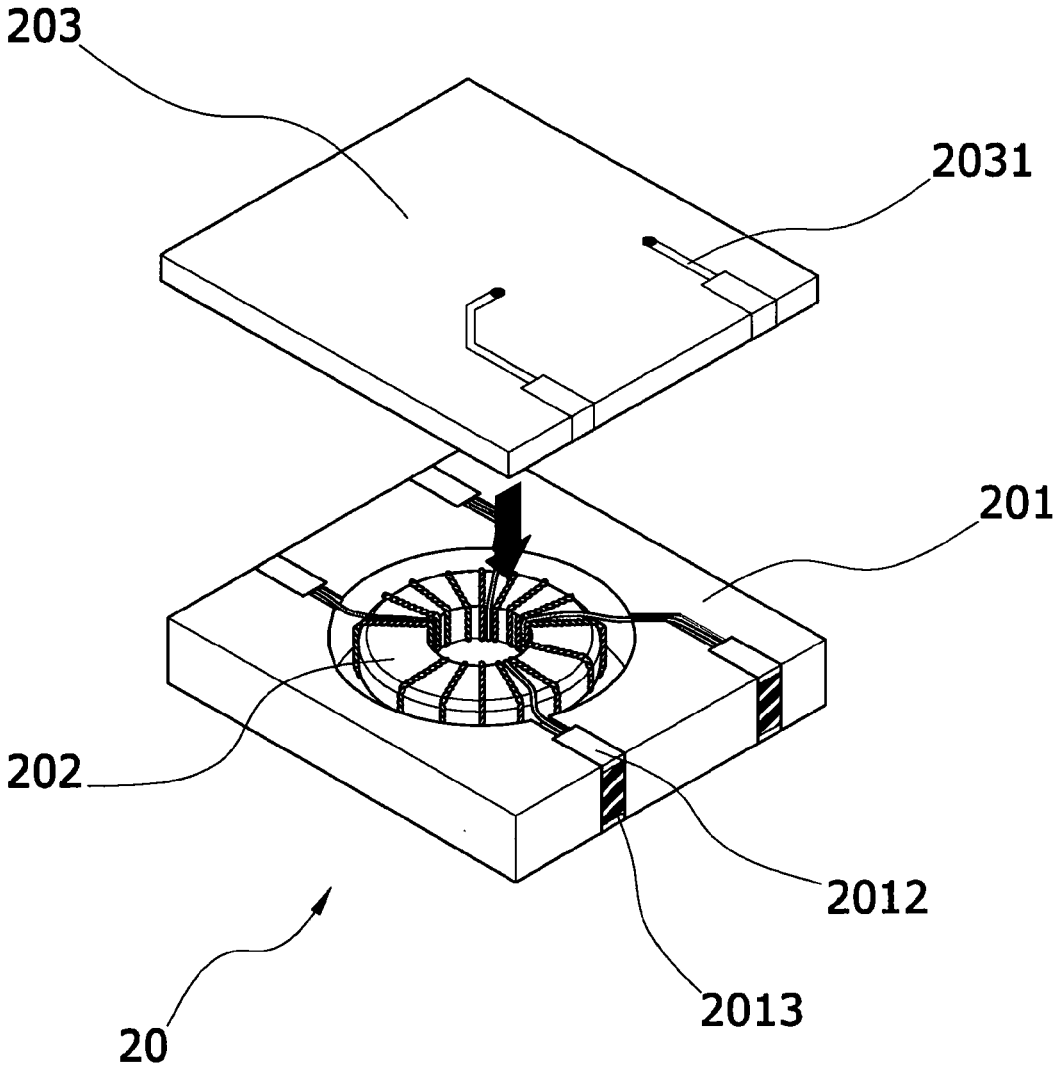
FIG. 8 is a second embodiment of the present invention.

FIG. 8 is a second embodiment of the present invention. Referring to FIG. 8, in the magnetic member 20, a cover plate 203 is further configured on an upper edge of the substrate 201, so that the carried relevant elements and the formed circuits on the magnetic member 20 may be protected by the cover plate 203, in which the cover plate 203 may be a ceramic substrate. Furthermore, an electrical line 2031 may be formed on a surface edge of the cover plate 203, and the electrical line 2031 may be electrically connected to the magnetic member 20 to form a magnetic member of a circuit board type after the integral manufacturing. Furthermore, in the above embodiment, as an example, a cover plate 203 is additionally disposed on the upper edge of the substrate 201, but the present invention is not limited thereto. The cover plate 203 may be additionally disposed on a lower edge of the substrate 201, or a cover plate 203 is respectively additionally disposed on the upper edge and the lower edge of the substrate 201.

Figure 9:
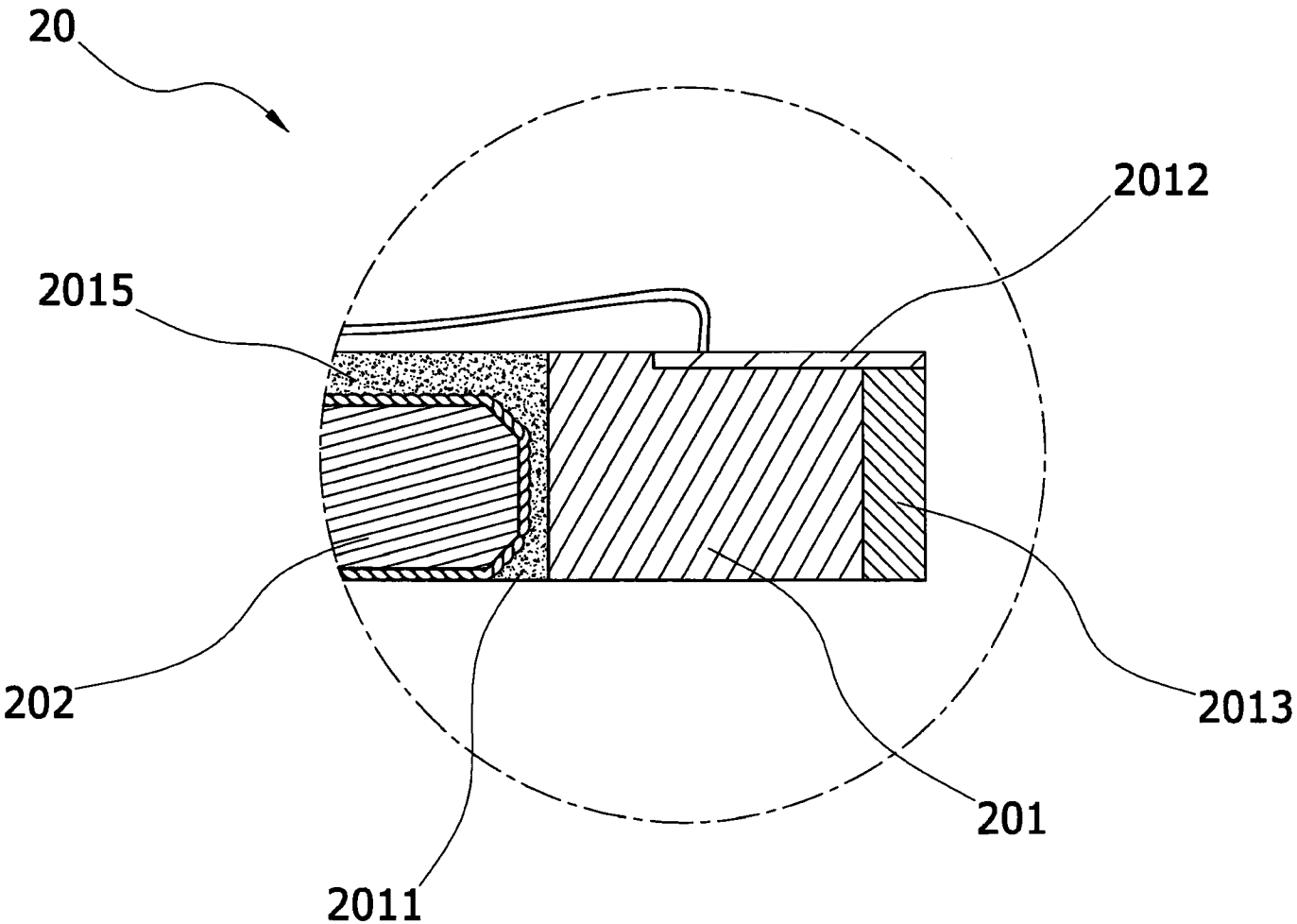
FIG. 9 is a third embodiment of the present invention.

FIG. 9 is a third embodiment of the present invention. Referring to FIG. 9, the configuration groove 2011 on the substrate 201 may be in a perforated form. According to this embodiment, during assembly, the magnetic element 202 is temporarily limited by a jig (not shown), and after the magnetic element 202 completes the configuration and the filling of the adhesive layer 2015 is completed, the jig is removed.

Figure 10:
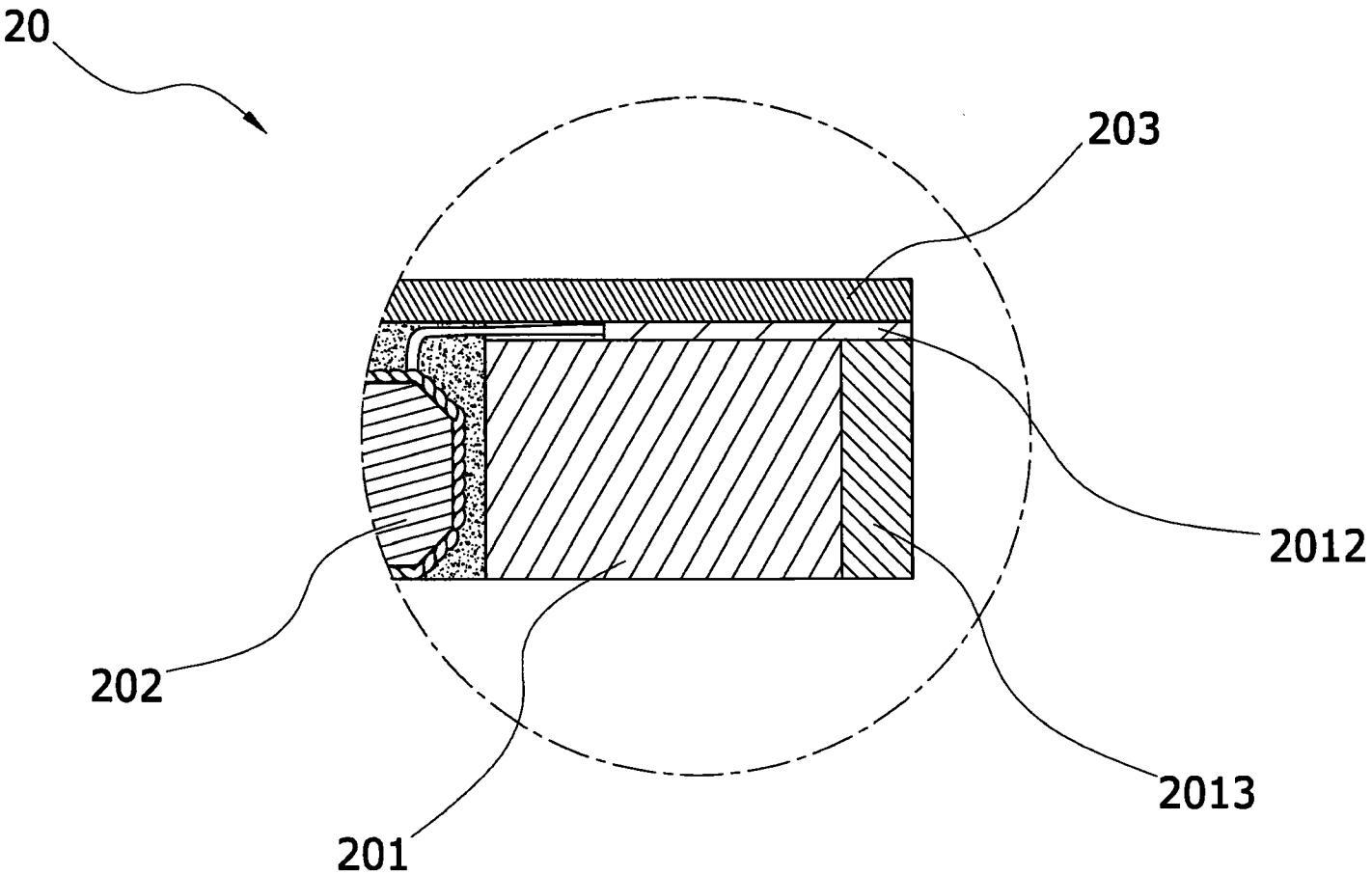
FIG. 10 is a fourth embodiment of the present invention.

FIG. 10 is a fourth embodiment of the present invention. Referring to FIG. 10, based on the descriptions of FIG. 9, when the above embodiment is implemented, a cover plate 203 may be configured on an upper edge of the substrate 201, so that relevant elements and circuits in the magnetic member 20 may be protected by the cover plate 203. An electrical line 2031 may also be formed on the cover plate 203, and a specific implementation situation is as described in FIG. 8. Furthermore, in this embodiment, as an example, the cover plate 203 is configured on the upper edge of the substrate 201, but the present invention is not limited thereto. The cover plate 203 may be configured on a lower edge of the substrate 201, or a cover plate 203 is respectively configured on the upper edge and the lower edge of the substrate 201.

To sum up, according to the present invention, the magnetic member mainly includes a substrate and a magnetic element. A penetrated-form guide groove is formed on a periphery of the substrate, the guide groove is filled with a conductive material, and the guide groove is electrically connected to a first electrode formed on a surface of the substrate. Furthermore, the magnetic element is accommodated in a guide groove formed on the substrate, and the conductive coil wound on the magnetic element is respectively electrically connected to the first electrode, so that in the IR reflow process of the magnetic member, the tin liquid may contact the surface edge of the guide groove, and the preferred "tin climbing phenomenon" is formed. Therefore, after the implementation of the present invention, a magnetic member which can avoid the adhesion condition and the poor conduction condition after the IR reflow process is obtained.

The above description is merely preferred embodiments of the present invention, but is not intended to limit the scope of the present invention. All the equivalent variations and modifications made by persons skilled in the art without departing from the spirit of the present invention should fall within the scope of the claims of the present invention.

What is claimed is:

1. A magnetic member, applicable to an electronic device, comprising:

a substrate, wherein a configuration groove is formed on the substrate, and a first electrode is formed on a surface of the substrate;

a magnetic element, accommodated in the configuration groove, wherein a conductive coil wound on the magnetic element is electrically connected to the first electrode; and a guide groove, penetrably formed on an edge of the substrate, wherein the guide groove is configured with the first electrode, and the guide groove is filled with a conductive material, so that the conductive material is electrically connected to the first electrode, wherein the guide groove steadily adheres the magnetic member to a circuit board, and wherein the guide groove is configured to increase a contact area of a tin liquid disposed on the guide groove.

2. The magnetic member according to claim 1, wherein the conductive material is electrically connected to a second electrode.

3. The magnetic member according to claim 1, wherein a cover plate is configured on an upper edge of the substrate.

4. The magnetic member according to claim 1, wherein a cover plate is configured on a lower edge of the substrate.

5. The magnetic member according to claim 1, wherein the configuration groove is filled with an adhesive layer.

6. The magnetic member according to claim 1, wherein the configuration groove is in a perforated form.

7. The magnetic member according to claim 6, wherein a cover plate is configured on an upper edge of the substrate.

8. The magnetic member according to claim 6, wherein a cover plate is configured on a lower edge of the substrate.

9. The magnetic member according to claim 6, wherein the configuration groove is filled with an adhesive layer.

10. A device, comprising:

a circuit board; and a magnetic member adhered to the circuit board, the magnetic member comprising:

a substrate, wherein a configuration groove is formed on the substrate, and a first electrode is formed on a surface of the substrate;

a magnetic element, accommodated in the configuration groove, wherein a conductive coil wound on the magnetic element is electrically connected to the first electrode;

a guide groove, penetrably formed on an edge of the substrate, wherein the guide groove is configured with the first electrode, and the guide groove is filled with a conductive material, so that the conductive material is electrically connected to the first electrode; and a tin liquid attached to a surface edge of the guide groove, wherein the guide groove and tin liquid adhere the magnetic member to the circuit board, and wherein the guide groove is configured to increase a contact area with the tin liquid.

* * * * *